United States Patent [19]

Swedberg

[11] Patent Number: 4,480,971

[45] Date of Patent: Nov. 6, 1984

[54] TWO-SPEED GEROTOR MOTOR

[75] Inventor: N. Einar Swedberg, Chanhassen, Minn.

[73] Assignee: Eaton Corporation, Cleveland, Ohio

[21] Appl. No.: 458,227

[22] Filed: Jan. 17, 1983

[51] Int. Cl.[3] ..... F01C 1/02; F03C 3/00

[52] U.S. Cl. ..... 418/61 B

[58] Field of Search ..... 418/61 B

[56] References Cited

U.S. PATENT DOCUMENTS

| | | | |
|---|---|---|---|
| 3,778,198 | 12/1973 | Giversen | 418/61 R |
| 3,799,201 | 3/1974 | Hansen et al. | 418/61 B |
| 3,892,503 | 7/1975 | Getman | 418/61 B |
| 4,181,067 | 1/1980 | Ortelli | 91/485 |

*Primary Examiner*—William R. Cline
*Assistant Examiner*—John J. McGlew, Jr.
*Attorney, Agent, or Firm*—C. H. Grace; L. J. Kasper

[57] ABSTRACT

A two-speed gerotor motor is disclosed of the type including a rotary disc valve member (55) of the type including valve passages (71 and 69) communicating between the inlet and outlet ports (61 and 65), respectively, and the fluid passages (57) defined by the port plate (19). The valve (55) also defines control valve passages (73) which communicate with an annular groove (75). Adjacent the valve member (55) is a valve seating mechanism (83) including a balancing ring member (85) which defines a plurality of axial passages (89) providing communication between a control fluid port (77) and the annular groove (75). As a result, the control valve passages may be communicated selectively with either the expanding volume chambers (29E) or the contracting volume chambers (29C).

6 Claims, 5 Drawing Figures

TWO-SPEED GEROTOR MOTOR

BACKGROUND OF THE DISCLOSURE

The present invention relates to rotary fluid pressure devices, and more particularly, to such devices which are capable of two different ratios between the flow of pressurized fluid and the speed of rotation of the input-output shaft.

Although the present invention may be used with rotary fluid pressure devices having various types of displacement mechanisms, it is especially advantageous when used with a device including a gerotor gear set, and will be described in connection therewith.

It has long been an object of those skilled in the gerotor motor (or pump) art to provide a simple, but efficient, two-speed gerotor motor. As used herein, the term "two-speed" means that for any given rate of fluid flow into the motor, it is possible to select between two different motor output speeds, a high speed (accompanied by a relatively low torque), and the conventional low speed (accompanied by a relatively high torque).

U.S. Pat. No. 3,778,198 discloses the basic concept for achieving two-speed (or dual ratio) operation of a gerotor motor. The concept disclosed in the reference patent involves providing switchable valving, in addition to the normal rotary valving in the motor, such that one or more of the expanding volume chambers can be placed in fluid communication with the contracting volume chambers, rather than with the fluid inlet, thus effectively reducing the displacement of the gerotor gear set to increase the motor output speed for a given rate of fluid flow to the motor. This is referred to as the high speed, low torque mode. On the other hand, if all of the expanding volume chambers are placed in fluid communication with the fluid inlet, the motor operates in its normal low speed, high torque mode.

Although U.S. Pat. No. 3,778,198 successfully discloses and teaches the basic concept described above, the motor shown in the reference patent is of the spool valve type which, because of the fixed diametral clearance between the rotating spool valve and the adjacent cylindrical housing surface, have been limited to relatively lower pressures and torques. However, the market for a two-speed gerotor motor is primarily in connection with applications requiring relatively higher pressures and torques, and as of the filing of the present application, the motor shown in U.S. Pat. No. 3,778,198 has not been commercialized, nor is any other two-speed gerotor motor commercially available.

SUMMARY OF THE INVENTION

Accordingly, it is an object of the present invention to provide a design for a two-speed gerotor motor which is compatible with the motors currently being used commercially for relatively high pressure and torque applications.

It is another object of the present invention to provide a two-speed gerotor motor design which may be applied as an optional feature to a standard gerotor motor, without the necessity of substantially redesigning the entire motor.

It is a further object of the present invention to provide a two-speed gerotor motor design wherein the motor is capable of operating at nearly normal mechanical and volumetric efficiencies in either mode of operation.

The above and other objects of the present invention are accomplished by the provision of a rotary fluid pressure device of the type including housing means defining fluid inlet means and fluid outlet means and a fluid energy-translating displacement means defining expanding and contracting fluid volume chambers. A stationary valve means defines fluid passage means in communication with the expanding and contracting volume chambers. A rotary disc valve member defines inlet and outlet valve passage means providing fluid communication between the inlet and outlet means, respectively, and the fluid passage means in the stationary valve, in response to rotary motion of the rotary disc valve member. The device includes a valve seating mechanism including a generally annular balancing ring member in engagement with a rear face of the rotary valve member. The balancing ring member is adapted to maintain the disc valve member in sealing engagement with the stationary valve means.

The device is characterized by the housing means defining control fluid passage means and the disc valve member defining control valve passage means disposed to provide fluid communication between the control fluid passage means and the fluid passage means of the stationary valve in response to the rotary motion of the disc valve member. The balancing ring member defines axial passage means comprising a portion of said control fluid passage means. The device includes valve means selectively operable between a first condition communicating said control fluid passage means to said fluid inlet means, and a second condition communicating said control fluid passage means to said fluid outlet means.

DESCRIPTION OF THE PREFERRED EMBODIMENT

Figure 1:
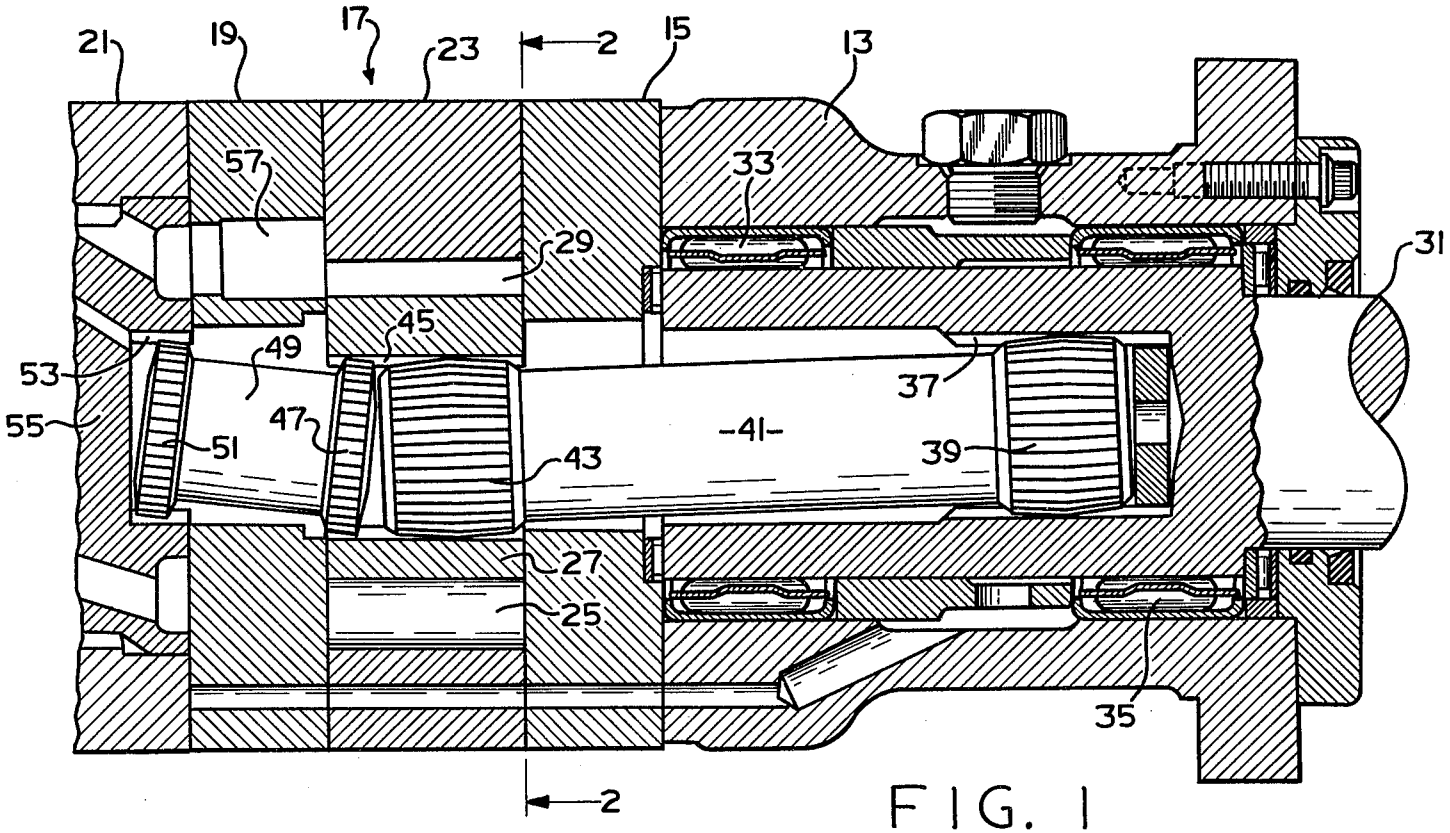
FIG. 1 is a fragmentary axial cross section of a fluid motor of the type with which the present invention may be utilized.

Referring now to the drawings, which are not intended to limit the invention, FIG. 1 is a fragmentary axial cross section of a fluid pressure actuated motor of the type to which the present invention may be applied, and which is illustrated and described in greater detail in U.S. Pat. No. 3,572,983, assigned to the assignee of the present invention and incorporated herein by reference. It should be understood that the term "motor" when applied to such fluid pressure devices is also intended to encompass the use of such devices as pumps.

Figure 2:
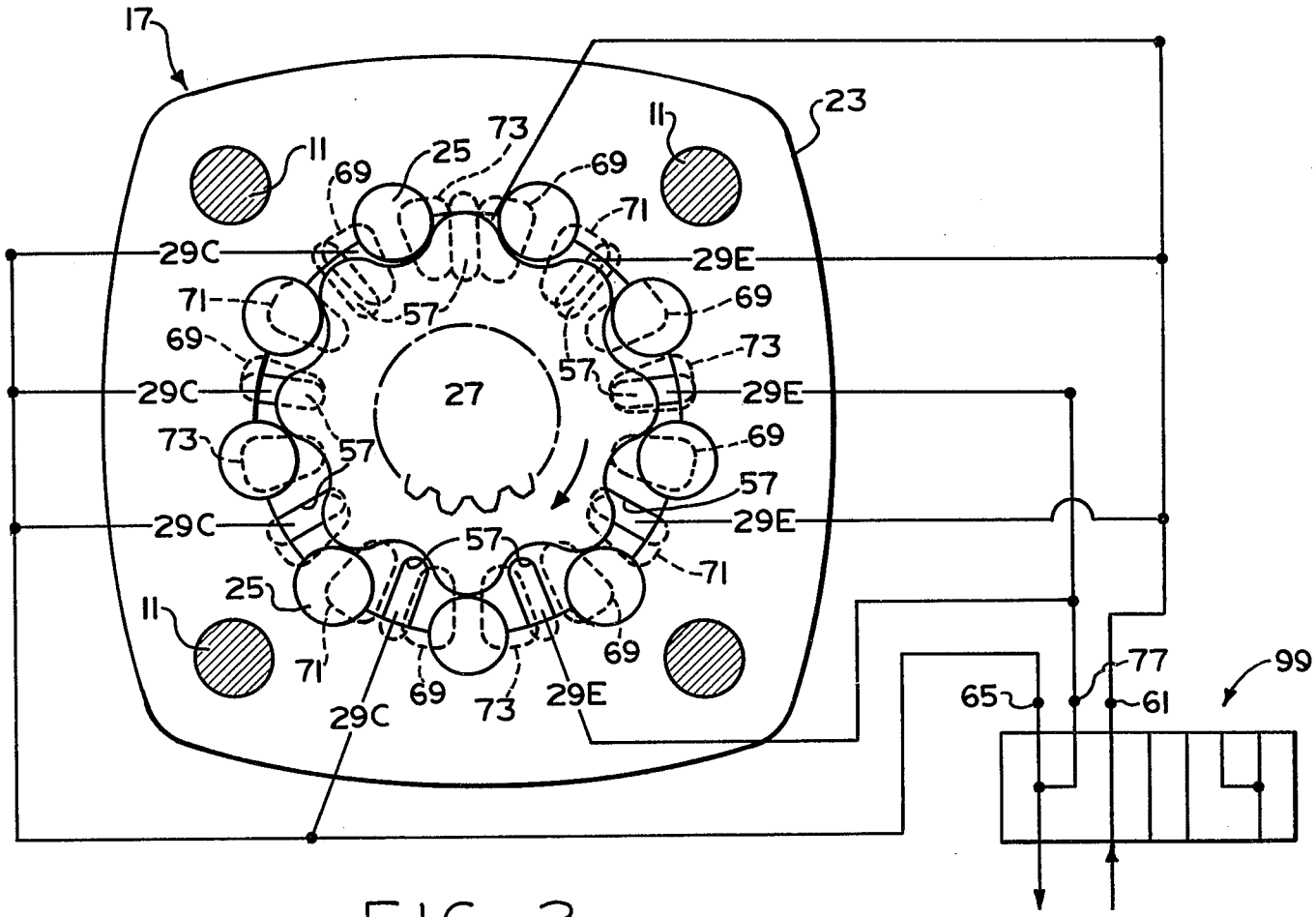
FIG. 2 is a view partly in schematic, and partly in transverse section on line 2—2 of FIG. 1, illustrating the operation of the hydraulic circuit associated with the present invention.

The fluid motor shown in FIG. 1 comprises a plurality of sections secured together, such as by a plurality of bolts 11 (shown only in FIG. 2). The motor includes a shaft support casing 13, a wearplate 15, a gerotor displacement mechanism 17, a port plate 19, and a valve housing portion 21.

The gerotor displacement mechanism 17 is well known in the art and will be described only briefly herein. In the subject embodiment, the mechanism 17 comprises a Geroler® gear set comprising an internally-toothed ring 23 defining a plurality of generally semi-cylindrical openings. Rotatably disposed in each of the openings is a cylindrical roll member 25, as is now well known in the art. Eccentrically disposed within the ring 23 is an externally-toothed rotor (star) 27, typically having one less external tooth than the number of rolls 25, thus permitting the star 27 to orbit and rotate relative to the ring 23. This relative orbital and rotational movement between the ring 23 and star 27 defines a plurality of expanding volume chambers 29E and a plurality of contracting volume chambers 29C (see FIG. 2; volume chamber designated merely as "29" in FIG. 1).

Referring again primarily to FIG. 1, the motor includes an output shaft 31 positioned within the shaft support casing 13 and rotatably supported therein by suitable bearing sets 33 and 35. The shaft 31 includes a set of straight internal splines 37, and in engagement therewith is a set of crowned external splines 39 formed on one end of a main drive shaft 41. Disposed at the opposite end of the drive shaft 41 is another set of crowned external splines 43, in engagement with a set of straight internal splines 45 formed on the inside of the star 27. In the subject embodiment, because the star 27 includes eight external teeth, eight orbits of the star 27 result in one complete rotation thereof, and as a result, one complete rotation of the drive shaft 41 and output shaft 31.

Figure 3:
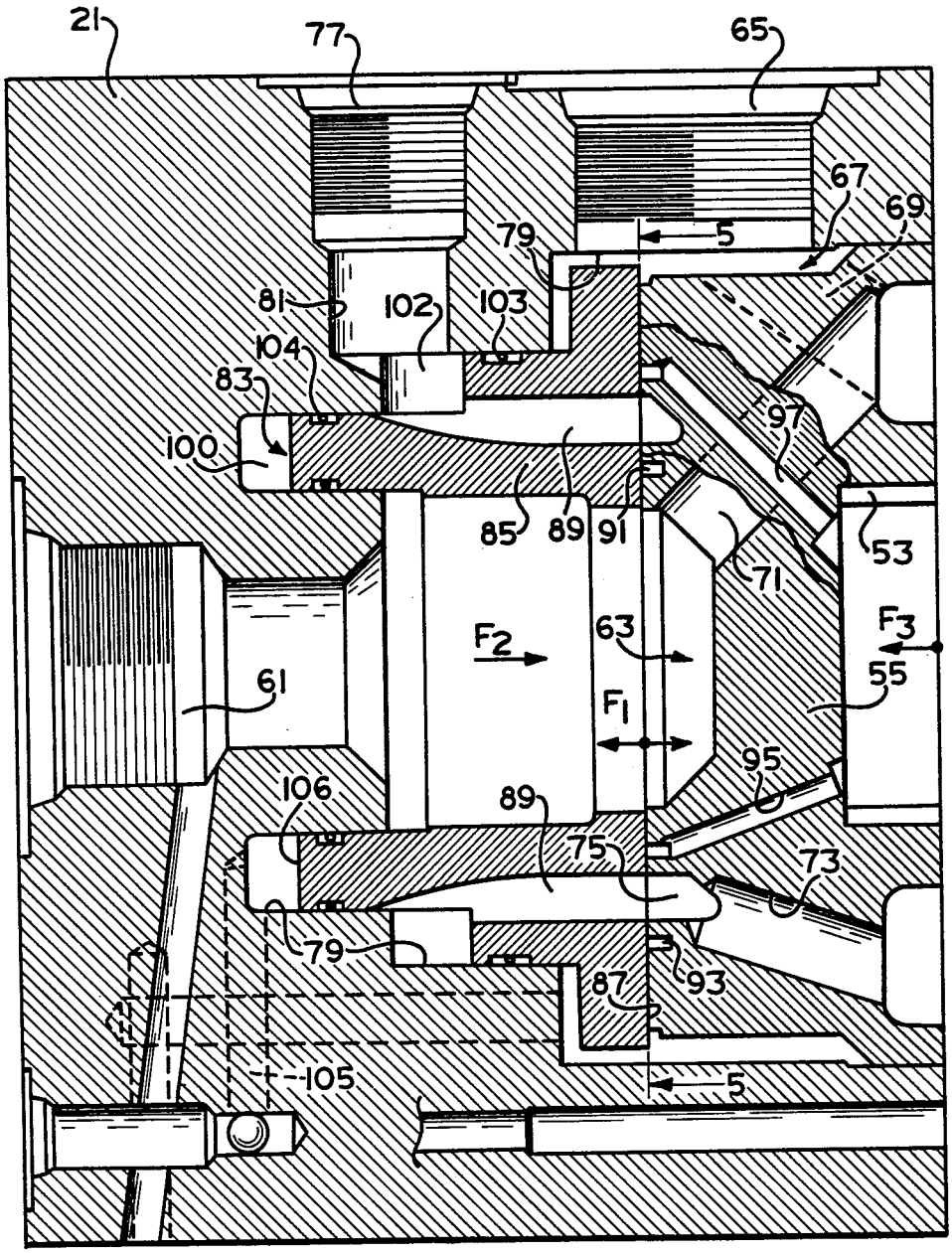
FIG. 3 is an axial cross section, similar to FIG. 1 but on a larger scale, illustrating the valve housing portion of the fluid motor of FIG. 1.
Figure 4:
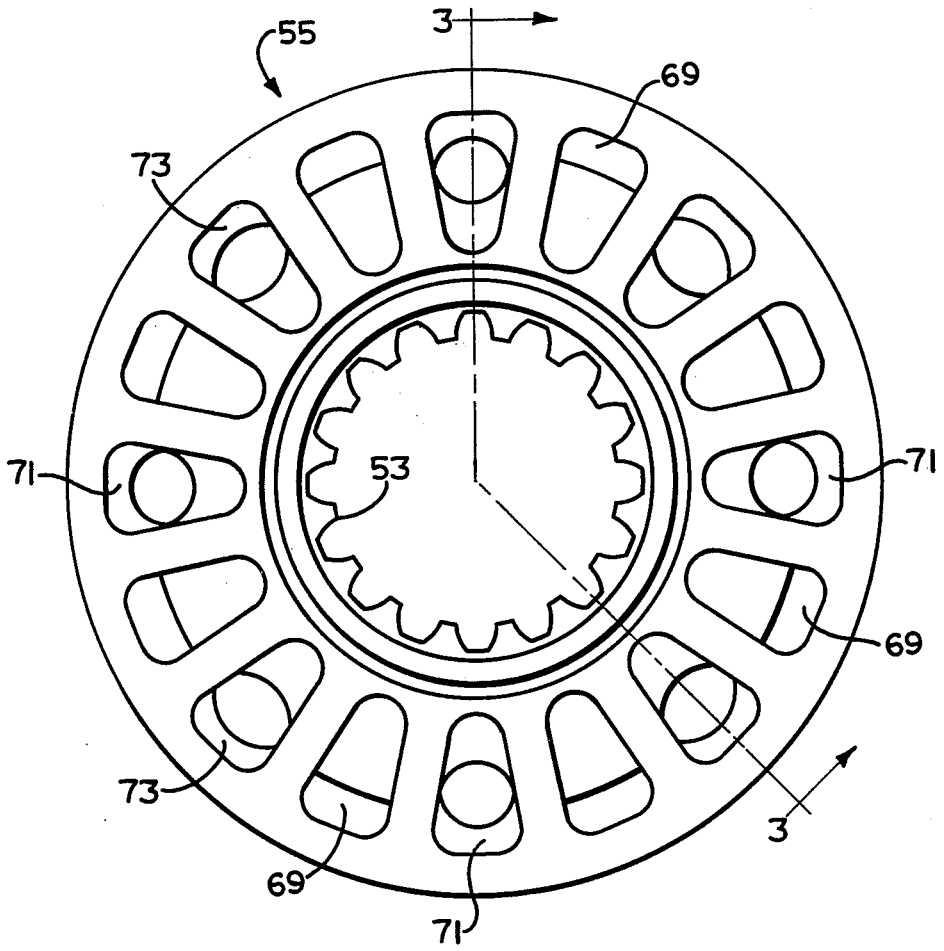
FIG. 4 is a front plan view of the rotary valve member shown in FIG. 3, and on the same scale as FIG. 3.
Figure 5:
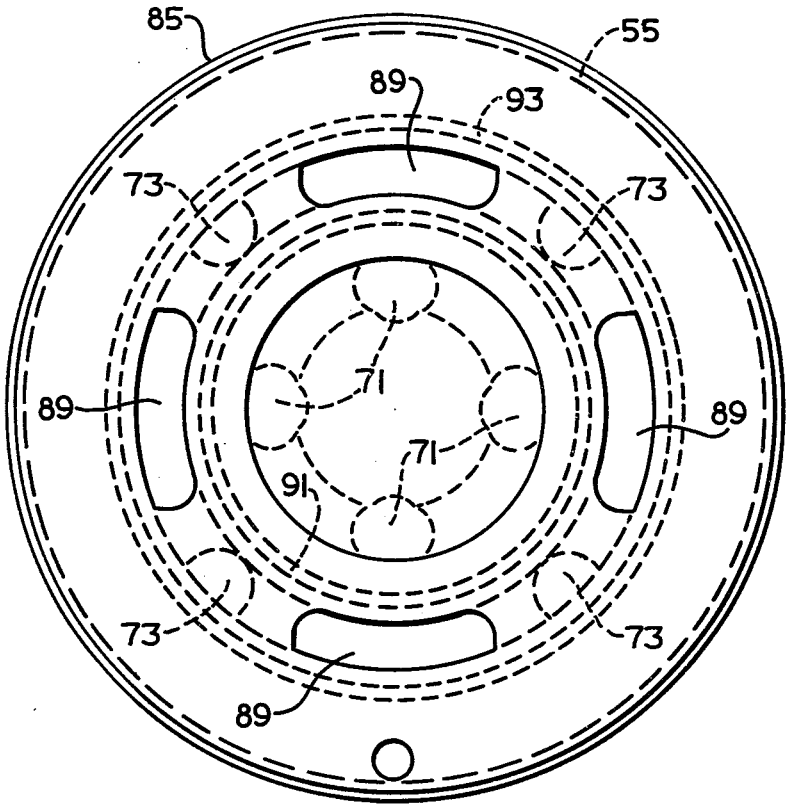
FIG. 5 is a transverse cross section, taken on line 5—5 of FIG. 3, and on the same scale as FIG. 3.

Also in engagement with the internal splines 45 is a set of external splines 47 formed about one end of a valve drive shaft 49 which has, at its opposite end, another set of external splines 51 in engagement with a set of internal splines 53 formed about the inner periphery of a valve member 55 (see FIGS. 1, 3, and 4). The valve member 55 is rotatably disposed within the valve housing 21, and the valve drive shaft 49 is splined to both the star 27 and the valve member 55 in order to maintain proper valve timing, as is generally well known in the art.

The port plate 19 defines a plurality of fluid passages 57, each of which is disposed to be in continuous fluid communication with an adjacent volume chamber 29 (see FIGS. 1 and 2). As is well known to those skilled in the art, as the star 27 orbits and rotates and the valve member 55 rotates, each of the fluid passages 57 will alternately communicate pressurized fluid to a volume chamber as it expands (29E), then communicate exhaust (return) fluid away from that same chamber as it contracts (29C).

Valve Housing Portion—FIG. 3

The valve housing portion 21 includes a fluid inlet port 61 in communication with an annular chamber 63 defined by the valve member 55. The valve housing 21 also includes a fluid outlet port 65 in communication with an annular chamber 67 which surrounds the valve member 55. As is well known to those skilled in the art, if the inlet and outlet ports 61 and 65 are reversed, the direction of rotation of the output shaft 31 will be reversed. The valve member 55 defines a plurality of valve passages 69 (shown only in dotted line in FIG. 3), in continuous fluid communication with the annular chamber 67. The valve member 55 also defines a plurality of valve passages 71 in continuous fluid communication with the annular chamber 63. The ports, chambers, and passages (elements 61—71) just described are well known in the art. In a typical prior art fluid motor of the type shown herein there would be eight of the valve passages 69 and eight of the valve passages 71, disposed to engage in commutating communication with the nine fluid passages 57, as shown in FIG. 2. However, in the present invention, there are eight of the valve passages 69, but only four of the valve passages 71. As a "substitute" for the other four valve passages 71 which would be present if the fluid motor were made in accordance with the prior art, the valve member 55 defines four contol valve passages 73. The valve member 55 also defines an annular groove 75 with which each of the control valve passages 73 communicates.

The valve housing 21 further defines a control fluid port 77 and a multi-stepped bore 79. Disposed in the bore 79 is a valve seating mechanism, generally designated 83, comprising a balancing ring member 85. A pair of annular chambers 100 and 102 are formed between the bore 79 and the balancing ring member 85. The annular chamber 102 is sealed from fluid communication with the chambers 67 and 100 by seal rings 103 and 104, respectively. The control port 77 and the annular chamber 102 are in continuous fluid communication through a control passage 81. A passage 105 connects the annular chamber 100 to the case drain region of the motor. The balancing ring member 85 includes an annular end surface 106, the area of which is selected to provide a hydraulic force $F_2$, biasing the ring member 85 to the right in FIG. 3, with a force that exceeds the separating force $F_3$, i.e., a hydraulic biasing force tending to separate the valve member 55 from the port plate 19. Preferably, the force $F_2$ exceeds the separating force $F_3$ by about 5 to about 20%.

The general construction and function of the mechanism 83 is well known to those skilled in the art, and illustrated and described in detail in above-incorporated U.S. Pat. No. 3,572,983. In accordance with the present invention, the configuration of the valve seating mechanism 83 differs from that known in the prior art. The balancing ring member 85 having a forward sealing surface 87 which is in sealing engagement with the adjacent, rearward surface of the valve member 55. The ring member 85 defines a plurality of axial passages 89 disposed to provide fluid communication between the control passage 81 and the annular groove 75 with which the control valve passages 73 communicate.

The valve member 55 defines an inner annular groove 91 and an outer annular groove 93. The inner groove 91 is in fluid communication with the central case drain region of the motor by means of a leakage passage 95, while the outer groove 93 is in fluid communication with the case drain region by means of a leakage passage 97. It will be understood by those skilled in the art that the grooves 91 and 93 could be defined by either the valve member 55 or balancing ring 85. The primary function of the grooves 91 and 93 is to limit the separating force, designated $F_1$, developed by the pressure gradient acting between the engaging surfaces of the valve member 55 and the ring member 85. Preferably, the separating force $F_1$ is limited to a level that is about 80 to 95% of the net hydraulic biasing force $F_2$. The second function of the drain grooves 91 and 93 is to collect the leakage fluid flowing between the engaging surfaces of the valve member 55 and the ring member 85. This leakage fluid is then communicated through the passages 95 and 97 to the case drain region of the motor, where it is used to lubricate the spline connections, the bearings, etc., as is well known in the art.

Operation

As was mentioned in the background of the present specification, the general concept and operation of a twospeed gerotor motor are known from U.S. Pat. No. 3,778,198, and therefore, operation of the present invention will be described only briefly herein.

Referring now primarily to FIGS. 2 and 3, the inlet port 61, the outlet port 65, and the control fluid port 77 are all connected to the outlet ports of a two position, switching control valve 99. The purpose of the switching valve 99 is to selectively communicate the control fluid port 77 with either the inlet port 61 or outlet port 65.

If the switching valve 99 is moved from the position shown in FIG. 2 to the lefthand position, in which the control port 77 is in communication with the inlet port 61, pressurized fluid will be communicated to both of the ports 61 and 77. The pressurized fluid will then flow from the inlet port 61 through the annular chamber 63 to the valve passages 71. At the same time, pressurized fluid will flow from the control port 77 through the control passage 81, then through the axial passages 89 and the annular groove 75 into the control valve passages 73. Therefore, with the switching valve 99 in the lefthand position, pressurized fluid is communicated through the inlet port 61 to two of the expanding volume chambers 29E, and through the control port 77 to the other two of the expanding volume chambers 29E. At the same time, low pressure return fluid is exhausted from each of the contracting volume chambers 29C through the valve passages 69 to the outlet port 65. Thus, with the switching valve 99 in the lefthand position, the fluid motor operates in the normal manner (referred to herein as the 1:1 ratio or the low speed, high torque mode) wherein pressurized fluid is communicated to all expanding volume chambers, and return fluid is exhausted from all contracting volume chambers.

Referring still primarily to FIGS. 2 and 3, if the switching valve 99 is moved to the righthand position (the position shown in FIG. 2), it may be seen that the valve 99 places the control fluid port 77 in fluid communication with the outlet port 65. With the valve 99 in the position shown, pressurized fluid is still communicated in the manner described previously through the inlet port 61 and chamber 63 to the valve passages 71. However, as may be seen in FIG. 2, this results in pressurized fluid being communicated to only two of the expanding volume chambers 29E, i.e., the two expanding volume chambers 29E wherein one of the valve passages 71 overlaps and communicates with the fluid passage 57 for that particular volume chamber.

Because the control port 77 is now in communication with the outlet port 65, low pressure return fluid is communicated through the control port 77, and through the control passage 81 and axial passages 89 and annular groove 75 to the control valve passages 73. This result in low pressure return fluid being communicated into two of the expanding volume chambers 29E, i.e., those expanding volume chambers wherein one of the control valve passages 73 overlaps and communicates with the fluid passage 57 for that particular volume chamber. Thus, with the switching valve 99 in the position shown in FIG. 2, pressurized fluid is communicated to only two of the four expanding volume chambers 29E, while low pressure return fluid is exhausted from all of the contracting volume chambers 29C, and a portion of this return fluid is communicated to the other two of the expanding volume chambers 29E. This results in orbital and rotational motion of the star 27 at a speed which is twice the orbital and rotational speed of the star in the 1:1 ratio, and therefore, the mode of operation just described is referred to as the 2:1 ratio or the high speed, low torque mode.

The present invention has been described in detail sufficient to enable one skilled in the art to make and use the same. It is believed that upon a reading and understanding of the specification, various alterations and modifications of the invention will become apparent to those skilled in the art. It is intended that all such alterations and modifications will be included as part of the invention, insofar as they come within the scope of the appended claims.

What is claimed is:

1. In a rotary fluid pressure device of the type including housing means defining fluid inlet means and fluid outlet means, fluid energy-translating displacement means defining expanding and contracting fluid volume chambers, stationary valve means defining stationary fluid passage means in fluid communication with said expanding and contracting volume chambers, a rotary disc valve member defining inlet and outlet valve passage means providing fluid communication between said inlet and outlet means, respectively, and said stationary fluid passage means in response to rotary motion of said disc valve member, and a valve seating mechanism including a generally annular balancing ring member in engagement with a rear face of said disc valve member, and adapted to maintain said disc valve member in sealing engagement with said stationary valve means, characterized by:

(a) said housing means defining control fluid passage means;

(b) said disc valve member defining control valve passage means disposed to provide fluid communication between said control fluid passage means and said stationary fluid passage means in response to said rotary motion of said disc valve member;

(c) said balancing ring member defining axial passage means comprising a portion of said control fluid passage means; and (d) valve means selectively operable between a first condition communicating said control fluid passage means to said fluid inlet means and a second condition communicating said control fluid passage means to said fluid outlet means.

2. A rotary fluid pressure device as claimed in claim 1 characterized by said balancing ring member being prevented from rotation relative to said housing means, said disc valve member being rotatable relative to said balancing ring member.

3. A rotary fluid pressure device as claimed in claim 2 characterized by said balancing ring member and said disc valve member cooperating to define an annular groove, said annular groove being in continuous fluid communication with both said control valve passage means and said axial passage means.

4. In a rotary fluid pressure device of the type including housing means defining fluid inlet means, fluid outlet means, and control fluid passage means, fluid energy-translating displacement means defining expanding and contracting fluid volume chambers, stationary valve means defining fluid passage means in fluid communication with said expanding and contracting volume chambers, rotary valve means defining inlet, outlet, and control valve passage means providing fluid communication between said fluid inlet, fluid outlet, and control fluid passage means, respectively, and said fluid passage means of said stationary valve means in response to operation of said valve means, control valve means selectively operable between a first condition communicating said control fluid passage means to said fluid inlet means and a second condition communicating said control fluid passage means to said fluid outlet means, characterized by:

(a) said rotary valve means comprising a rotary disc valve member and a valve seating mechanism including a generally annular balancing ring member in engagement with a rear face of said rotary disc valve member, and adapted to maintain said valve member in sealing engagement with said stationary valve means; and (b) said balancing ring member being disposed to separate said fluid inlet means from said fluid outlet means and defining axial passage means comprising a portion of said control fluid passage means, separated from fluid communication with both said fluid inlet and outlet means.

5. A rotary fluid pressure device as claimed in claim 4, characterized by said displacement means comprising a gerotor gear set including an internally-toothed member and an externally-toothed member disposed eccentrically within said internally-toothed member for relative orbital and rotational movement therebetween.

6. A rotary fluid pressure device as claimed in claim 5 characterized by the valving action between said rotary disc valve member and said stationary valve means rotating at the speed of relative rotation between said internally-toothed and externally toothed members.

* * * * *